United States Patent [19]

Hermawan

[11] 4,299,321

[45] Nov. 10, 1981

[54] MOVING WALKWAY

[76] Inventor: Samuel S. Hermawan, 2707 Lincoln Way, Apt. 303, Ames, Iowa 50010

[21] Appl. No.: 98,495

[22] Filed: Nov. 29, 1979

[51] Int. Cl.[3] ..... B65B 15/00

[52] U.S. Cl. ..... 198/321; 104/25; 198/838; 198/845

[58] Field of Search ..... 104/18, 20, 21, 23, 104/28, 30; 198/321, 324, 334, 838, 845; 108/20, 22; 186/46, 58

[56] References Cited

U.S. PATENT DOCUMENTS

| | | | |
|---|---|---|---|
| 1,475,077 | 11/1923 | Mangim | 104/25 |
| 1,933,554 | 11/1933 | Holmes | 198/838 X |
| 2,044,134 | 6/1936 | Storer | 104/25 |

*Primary Examiner*—Robert B. Reeves
*Assistant Examiner*—Douglas D. Watts
*Attorney, Agent, or Firm*—Zarley, McKee, Thomte, Voorhees & Sease

[57] ABSTRACT

The present invention utilizes a continuously moving street or road formed from a continuous chain of cars having flexible couplings therebetween. The upper surface of the moving conveyor is at approximately the same level as the supporting surface along the track which carries the conveyor, so that persons may step onto the conveyor without having to step up or down. The running street or road can be driven continuously by internal combustion engines, electricity, or other conventional drive means for vehicles. The speed of the road may be adjusted so as to maximize safety and so as to make it easy for persons to step onto the moving conveyor. Fans or cooling systems are provided below the cars to cool the air beneath the cars caused by continuous running. The spaces between the cars are covered by elastic support members.

3 Claims, 4 Drawing Figures

MOVING WALKWAY

BACKGROUND OF THE INVENTION

The present invention relates to personnel carriers, and specifically to a personnel conveyor formed into a continuous moving road or street.

Various types of mass transit have been utilized in order to make more efficient use of energy for transportation. Most of these mass transit systems, however, are unsatisfactory from several different standpoints. Railroad systems utilize numerous cars connected together in end to end relationship. However, it is necessary to step up onto these cars and there are often spaces between the cars which create dangers. Furthermore, it is necessary for these railroad systems to start and stop to pick up passengers.

Another form of mass transit, the subway, utilizes tracks which are mounted in a trench. These subways, however, do not completely cover the trench and consequently the trench is exposed the majority of the time, thereby creating a safety hazard where persons may fall in and be injured.

SUMMARY OF THE INVENTION

The present invention utilizes a continuous moving street which presents a horizontal moving surface located at substantially the same level as the ground. Thus, persons may step onto the moving surface and be carried to their destination. The moving surface moves continuously and it is not necessary to start and stop the movement in order for passengers to board.

Seats may be provided as well as hand rails for permitting the passengers to steady themselves.

The moving surface is supported by a plurality of cars located in a recessed track. The cars are secured in end to end relationship around the entire circumference of the continuous track. The spaces between the cars are covered by flexible coupling surfaces which provide a smooth continuous surface from one car to another. The cars are driven by any desirable power means such as internal combustion engines, electricity, or other conventionally known means.

Therefore, a primary object of the present invention is the provision of an improved personnel carrier.

A further object of the present invention is the provision of a conveyor which can move continuously and which persons can board without requiring the cessation of conveyor movement.

A further object of the present invention is the provision of a conveyor which presents a continuous horizontal surface along its entire length and which does not expose the supporting track beneath the conveyor.

A further object of the present invention is the provision of a conveyor which has improved safety characteristics over previous conveyors.

A further object of the present invention is the provision of a conveyor which minimizes the number of personnel required to operate it.

A further object of the present invention is the provision of a conveyor which conveys a large number of persons with a minimum use of energy.

A further object of the present invention is the provision of a conveyor which can be adapted for use in streets presently existing in cities.

A further object of the present invention is the provision of a conveyor which is economical to manufacture, durable in use and efficient in operation.

DETAILED DESCRIPTION OF THE INVENTION

Figure 1:
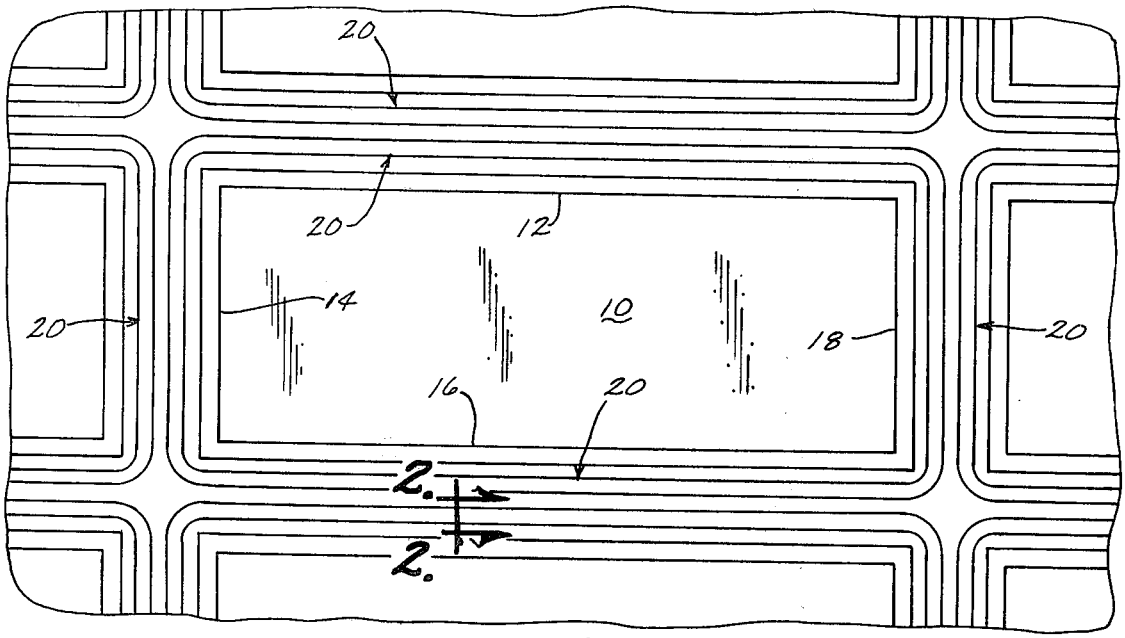
FIG. 1 is a plan view of a street system having conveyors of the present invention utilized therein.

Referring to the drawings, the numeral 10 designates a conventional city block bounded on four sides by four streets 12, 14, 16 and 18. The present invention utilizes a continuous conveyor 20 which is shown in FIG. 1 to extend around block 10. While conveyor 20 is shown to extend around a city block, such a conveyor could be utilized in any of a number of configurations depending upon the particular traffic pattern layout of a given area. It is preferable, however, that conveyor 20 be a continuous loop so that a continuous moving surface may be provided.

Conveyor 20 is comprised of a plurality of cars 22 joined together in end to end relationship. The cars run in a continuous track 24 which includes opposite vertical side walls 26, 28 and a road bed 30. A pair of gutters 32, 34 are provided at the juncture between walls 26, 28 and roadbed 30 as to provide adequate drainage of the road bed. Mounted in road bed 30 are a pair of parallel railroad rails 36, 38 which extend along the longitudinal centerline of track 24 in conventional fashion. The upper ends of side walls 26, 28 are provided with outwardly extending grooves 40, 42, respectively, and with inwardly extending lips 44, 46 respectively.

Each car 22 includes a plurality of wheel assemblies 48. Each wheel assembly 48 includes a pair of wheels 50 interconnected by an axle 52. Axle 52 is supported below a horizontal platform 54 by two shock absorbing means 56, 58 each of which comprises a pair of telescoping members 60, 62 and a spring 64. Running along the sides of platform 54 are a pair of side members 66. Mounted above platform 54 are a set of hand rails 68 for grasping by passengers. In addition to hand rail 68, additional means such as seats and cab enclosures may be provided, but are not shown in the drawings.

Figure 2:
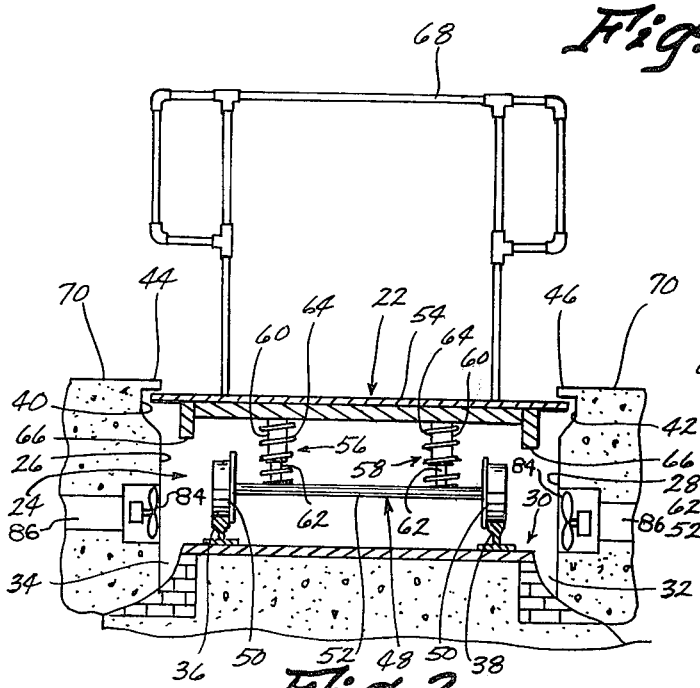
FIG. 2 is a sectional view taken along line 2—2 of FIG. 1.

The lateral edges of platform 54 extend within grooves 40, 42 and below lips 44, 46 in close spaced relationship to lips 44, 46. As can be seen in FIG. 2, the level of platform 54 is approximately the same as the level of the supporting surface 70 on each side of the conveyor. Thus, persons may step onto platform 54 easily without having to step up or down.

Figure 4:
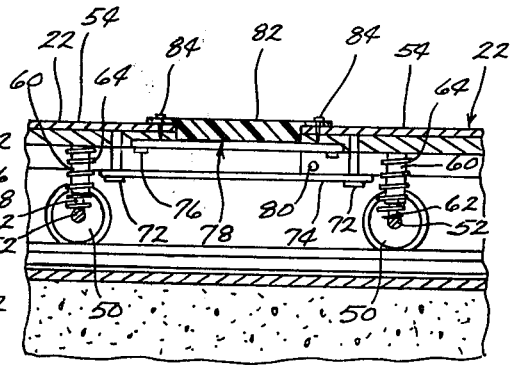
FIG. 4 is a partial sectional view showing the interconnection between two cars in the conveyor.
Figure 3:
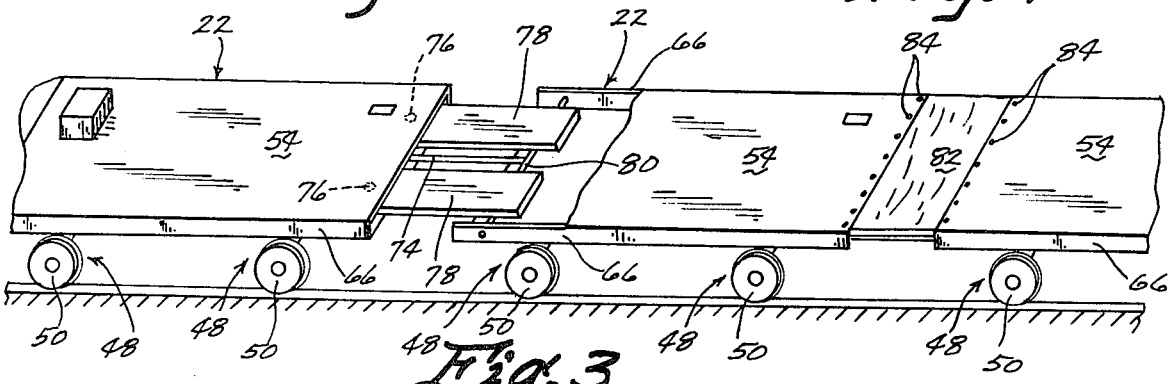
FIG. 3 is a partial perspective view showing portions of the conveyor broken away.

Referring to FIGS. 3 and 4, the means for interconnecting cars 22 are shown. Each car 22 includes at its end a downwardly extending stub 72. A coupling link 74 is pivotally connected at its opposite ends to the stubs 72 of the two adjoining ends of cars 22 as shown in FIG. 4. This permits cars 22 to pivot with respect to one another. Link 74 holds the ends of the adjoining platforms 54 in spaced relationship so they will not interfere with one another as cars 22 pass around a corner or curve in the track.

The rearward end of each car 22 is provided with a pair of vertical bearing members 76 which extend downwardly from platform 54 and which provide pivotal mounting for a pair of support plates 78. Support plates extend rearwardly from car 22 and span the distance between the platforms 54 of the two cars. The rearward end of plates 78 rest upon a horizontally extending bar 80 which extends transversely of car 22 adjacent the forward end thereof between the two spaced apart side members 66. Bar 80 provides a bearing support for plates 78 so that plates 78 may slide longitudinally with respect to bar 80 as cars 22 pass around a corner or a curve in the track. Bar 80 may be stationary in which case frictional sliding movement between plate 78 and bar 80 occurs. Preferably, however, bar 80 should be rotatable so as to provide a rolling bearing engagement with plates 78.

Spanning the distance between the two adjoining ends of platforms 54 is a flexible pad 82, which rests in supporting engagement on plates 78 and which is secured at its opposite ends to platforms 54 by rivets 84 or other conventional securing means. Pad 82 provides a relatively smooth continuous surface between the upper surfaces of the platforms 84 of two adjoining cars. Plates 78 provide support for pad 82 but because of its flexible nature, pad 82 can flex during movement of the cars around a curve or corner.

Cars 22 are connected together in a continuous chain around the entire length of conveyor 20 so that the upper surfaces of platforms 54, together with the upper surfaces of pads 82 provide a continuous flat surface upon which passengers may step. Fans 84 introduce cooling air to track 24 from air vents 86. The means for powering cars 20 may be done by any presently known method. Internal combustion engines may be used to drive the cars, or electrical motors may also be used. The conveyor of the present invention provides continuous movement without any starting and stopping, thereby making the moving conveyor available to persons at all times. Furthermore, because the surface of platforms 54 is substantially the same as the supporting surfaces along the conveyor, safety of the device is enhanced. Thus, it can be seen that the device accomplishes at least all of its stated objectives.

What is claimed is:

1. A personnel conveyor comprising:

a continuous track comprising in cross section a pair of vertical sidewalls and a bottom wall extending between the lower edges of said sidewalls, each of said sidewalls having at its upper edge a lip flange extending inwardly toward the longitudinal centerline of said track;

a pair of spaced apart parallel rails mounted on said bottom wall and extending longitudinally along said track;

a plurality of cars connected together in end to end relation, each of said cars having supporting wheels in retentive engagement with said rails for rolling along the length thereof, a horizontal platform and frame means connecting said horizontal platform to said supporting wheels for holding said horizontal platform in a position wherein the lateral edges protrude below said lip flanges of said sidewalls in close spaced relation thereto;

a horizontal supporting surface extending from each of said lip flanges in a lateral direction away from the longitudinal centerline of said track, connecting means connecting each of said cars in end to end relation along the entire length of said continuous track whereby said cars form an endless conveyor;

a flexible flat horizontal support member at each juncture between said cars, said support member being connected to the adjoining ends of one pair of said cars and forming a smooth continuation of the upper horizontal surfaces of said platforms whereby said platforms and said horizontal support members together form a continuous horizontal surface along the entire length of said track; and power means for moving said cars along said track, air ventilation means being in communication with said track below said platform for introducing cooling air to said track.

2. A personnel conveyor according to claim 1 wherein a plurality of handrails are attached to said platforms and extend upwardly therefrom for grasping by passengers.

3. A personnel carrier according to claim 2 wherein the upper surface of said platform is covered with a non-slip material.

* * * * *